United States Patent [19]

Yokoi

[11] Patent Number: 4,978,112

[45] Date of Patent: Dec. 18, 1990

[54] SHEET FEEDER FOR PRINTER

[75] Inventor: Takeshi Yokoi, Kagamihara, Japan

[73] Assignee: Brother Kogyo Kabushiki Kaisha, Nagoya, Japan

[21] Appl. No.: 180,125

[22] Filed: Apr. 11, 1988

[30] Foreign Application Priority Data

Apr. 10, 1987 [JP] Japan ..... 62-55155[U]

[51] Int. Cl.[5] ..... B65H 3/44

[52] U.S. Cl. ..... 271/9; 271/116; 271/117; 271/127; 271/160; 271/171; 400/629; 400/647

[58] Field of Search ..... 271/9, 10, 109, 114, 271/116, 117, 126, 127, 145, 149, 147, 160, 171, 240; 400/624, 625, 629, 632.1, 632, 633, 646, 647, 647.1

[56] References Cited

U.S. PATENT DOCUMENTS

| | | | |
|---|---|---|---|
| 4,248,415 | 2/1981 | Steinhilber | 271/9 |
| 4,538,799 | 9/1985 | Bhagwat | 271/117 |
| 4,564,187 | 1/1986 | Costa et al. | 271/9 |
| 4,570,919 | 2/1986 | Huang | 271/9 |
| 4,577,849 | 3/1986 | Watanabe | 271/9 |
| 4,632,379 | 12/1986 | Steinhilber | 271/160 |
| 4,645,192 | 2/1987 | Watanabe | 271/9 |
| 4,664,546 | 5/1987 | Rünzi | 400/624 |
| 4,667,947 | 5/1987 | Costa et al. | 271/9 |
| 4,711,442 | 12/1987 | Runzi | 271/127 |
| 4,765,605 | 8/1988 | Abbott | 271/127 |
| 4,838,535 | 6/1989 | Yokoi et al. | 271/171 X |
| 4,861,017 | 8/1989 | Yamamoto et al. | 271/145 X |
| 4,863,153 | 9/1989 | Steinhilber | 400/629 X |
| 4,865,305 | 9/1989 | Momiyama et al. | 400/624 X |

FOREIGN PATENT DOCUMENTS

| | | | |
|---|---|---|---|
| 0211566 | 2/1987 | European Pat. Off. . | |
| 0230507 | 8/1987 | European Pat. Off. . | |
| 1906873 | 7/1979 | Fed. Rep. of Germany | 271/117 |
| 57841 | 4/1984 | Japan | 271/109 |
| 183441 | 9/1985 | Japan | 271/9 |
| 9971 | 1/1987 | Japan | 400/624 |
| 2132591 | 7/1984 | United Kingdom . | |
| 8808410 | 6/1988 | United Kingdom . | |

OTHER PUBLICATIONS

Fallon et al., "Sheet Feeding Apparatus", 12-1976, p. 2440, vol. 19, No. 7.

*Primary Examiner*—Joseph J. Rolla
*Assistant Examiner*—Boris Milef
*Attorney, Agent, or Firm*—Jones, Tullar & Cooper

[57] ABSTRACT

A sheet feeder is disclosed, which is mounted in a printer for feeding cut printing sheets one by one to a printing position in the printer. The sheet feeder comprises first and second sheet accommodation sections for accommodating respective stacks of printing sheets. First and second feed roller mechanisms are provided for the respective sheet accommodation sections. These roller mechanisms selectively receive a drive torque from a single reversible drive motor via a selective coupling mechanism. The selective coupling mechanism senses the direction of rotation of the drive motor, and selectively couples the drive motor to either one of the first and second roller mechanisms according to the sensed direction of rotation.

8 Claims, 6 Drawing Sheets

SHEET FEEDER FOR PRINTER

BACKGROUND OF THE INVENTION

This invention relates to a sheet feeder mounted in a printer for feeding cut sheets for printing one by one to a printing position of the printer.

In a prior art sheet feeder of the pertaining type, a plurality of, e.g., two sheet holder sections are provided for holding respective stacks of printing sheets of different sizes. Feed roller pairs are each provided for each of these sheet holder sections such that they can be selectively rotated to feed sheets from a corresponding sheet holder section In such a prior art sheet feeder, however, a drive motor is provided in each sheet holder section to drive each feed roller pair. This means that an independent mechanism for coupling drive torque is provided from each motor to the associated sheet holder section. This arrangement complicates and increases the size of the construction of the sheet feeder, thus increasing the cost of manufacture.

There is a sheet feeder which uses a common drive motor for a plurality of sheet holder sections. In this case, solenoid units are provided such that they are selectively operable to select corresponding sheet holder sections. This sheet feeder, therefore, has a complicated electric circuit for solenoid unit selection control, thus presenting problems like those noted above.

The prior art sheet feeders as described above are disclosed in United States patent specification Nos. 4,564,187, 4,577,849, 4,645,192, 4,664,546 and 4,667,947.

A prior art sheet feeder comprises opposite side sheet support members for supporting the opposite sides of a stack of sheets and an intermediate sheet support member provided between the opposite side sheet support members for supporting the back of the sheet stack, these members being supported with respect to the sheet feeder frame for displacement in the width direction of the sheet so that the sheet feeder will comply with a change in the width size of the printing sheet.

In the prior art sheet feeder, however, the intermediate sheet support member that is provided between the opposite side sheet support members is mounted on the sheet feeder frame such that it can not be removed. Therefore, it is difficult to hold a stack of narrow printing sheets, e.g., postal cards, which are extremely different from normal size sheets by making use of the sheet support members. This is so because the intermediate sheet support member is considerably wide so that it interferes with the displacement of the opposite side sheet supports to positions close to each other, that is, the opposite side sheet supports can not be brought to close-to-each-other positions complying with the size of the narrow printing sheet, such as a postal card. The feed rollers also can not be in contact with the printing sheet, so that the printing sheet can not be fed.

In order to be able to bring the opposite side sheet support members to the close-to-each-other positions complying with a narrow printing sheet, an intermediate sheet support member having a reduced width has to be used. However, a narrow intermediate sheet support member is liable to be readily deformed by the weight of the supported sheet stack so that it can not sufficiently support the back of the sheet stack.

SUMMARY OF THE INVENTION

An object of the invention is to provide a sheet feeder for a printer, which can solve the above problems inherent in the prior art sheet feeder, can operate a plurality of sheet accommodation sections from a common drive source, and in which torque coupling means from the common drive source to each sheet accommodation section has a simplified structure.

Another object of the invention is to provide a sheet feeder for a printer, which can accommodate a stack of printing sheets having a predetermined width and also permits ready displacement of opposite side sheet support members to close-to-each-other positions complying with the width of the printing sheets so that a stack of extraordinarily narrow printing sheets, e.g., postal cards, can also be accommodated in lieu of printing sheets having normal size.

To attain the above objects of the invention, there is provided a sheet feeder for a printer, which is mounted in the printer for feeding cut printing sheets one by one to a printing position in the printer, and comprises first and second sheet accommodation sections for accommodating respective stacks of printing sheets, first and second roller means provided for the respective first and second sheet accommodation sections for feeding out printing sheets from the sheet accommodation sections to the printing position, a reversible drive motor, and a selective coupling mechanism for sensing the direction of rotation of the reversible drive motor, selectively coupling the drive motor to either the first or second feed roller means in accordance with the sensed direction of rotation and causing rotation of the selected feed roller means in a feeding direction.

With the sheet feeder according to the invention, by switching the direction of rotation of the drive motor either forwards or backwards the feed roller means for either one of the sheet accommodation sections is rotated in the feeding direction through the selective coupling mechanism to selectively feed out printing sheets in the selected sheet accommodation section, as well as simplifying the construction and reducing the size and cost of manufacture of the sheet feeder.

Further, since the selective coupling mechanism selectively couples the motor torque to the selected one of the first and second feed roller means, the sheet feeder does not require electric control means or like particular switching means.

Still further, in a preferred structure according to the invention the selective coupling mechanism includes a plurality of gears capable of being brought into mesh with one another and is common to the first and second sheet accommodation sections, thus promoting the simplification of the structure, size reduction and price reduction.

Yet further, in another preferred structure according to the invention opposite side sheet support members for supporting the opposite sides of a stack of printing sheets, and an intermediate sheet support member provided intermediate between the opposite side sheet support members for supporting the back of the sheet stack, at least one of the opposite side sheet support members being movable in the width direction of the sheet, the intermediate sheet support member being removably supported.

With this structure of the sheet feeder, for supporting a stack of narrow printing sheets, i.e., postal cards, the opposite side sheet support members can be brought to close-to-each-other positions complying with the width of the printing sheets. That is, the sheet feeder can quickly adapt itself to sheets having particular sizes.

These and other aspects and advantages of the present invention will be more completely described with reference to the accompanying drawings.

DESCRIPTION OF THE PREFERRED EMBODIMENT

Figure 1:
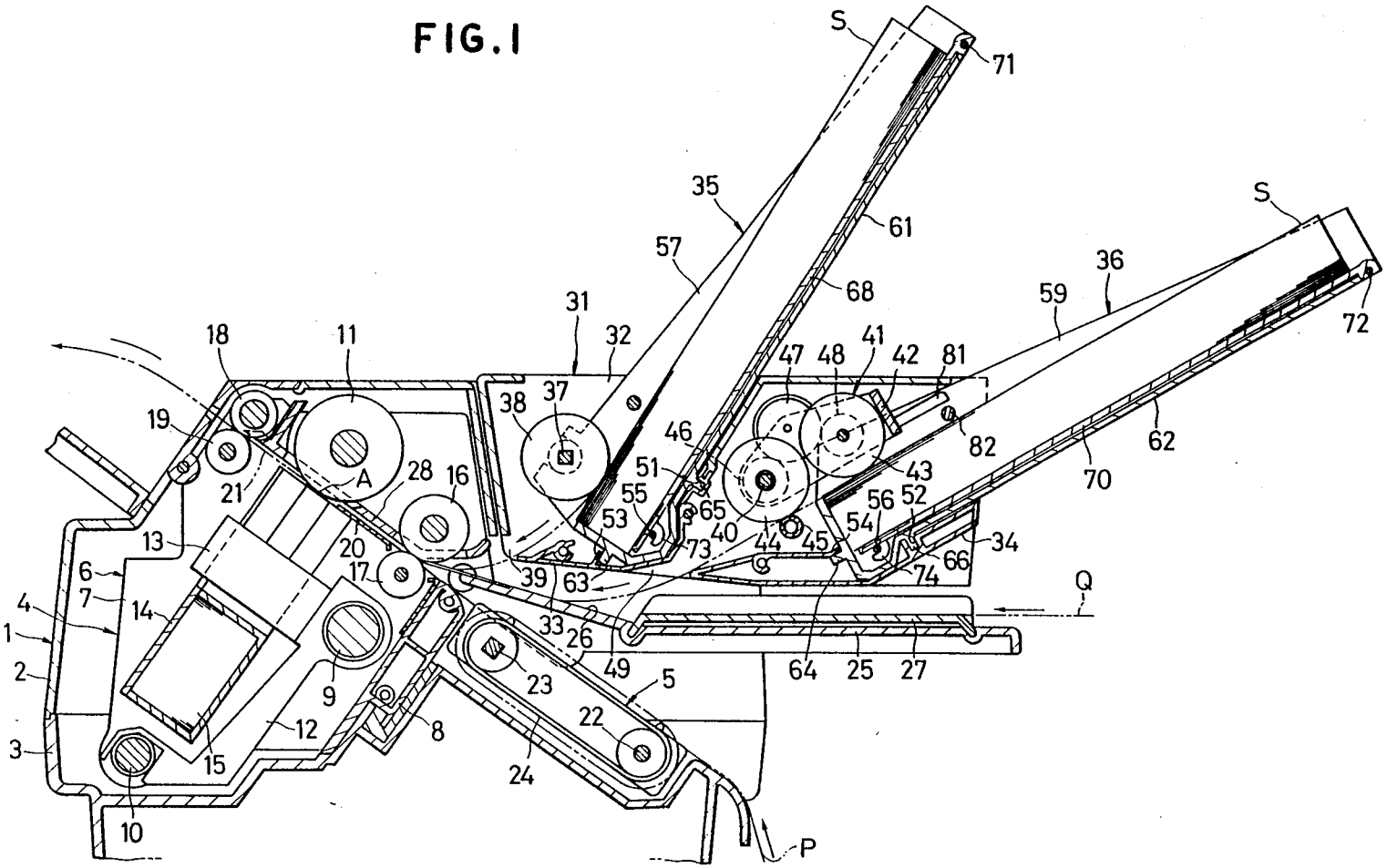
FIG. 1 is a fragmentary longitudinal sectional view showing a printer employing a sheet feeder embodying the invention.

FIG. 1 shows a printer employing a sheet feeder according to the invention. The illustrated printer comprises a printer case 1 which consists of upper and lower cases 2 and 3 assembled together. The printer case 1 accommodates a printing unit 4 and a tractor unit 5 constituting tractor means The printing unit 4 has a frame 6, which is found in a front portion of the printer, i.e., in a left side area in FIG. 1. The frame 6 includes opposite side plates, a hollow bar 8 and two round bars 9 and 10, these bars connecting the side plates. A cylindrical platen 11 is rotatably supported between the side plates 7 above the guide bars 9 and 10.

A carriage 12 is supported for movement in transverse directions along the guide bars 9 and 10. It carries an upper printing head 13 which faces the platen obliquely upwardly. A ribbon cassette 14 is disposed between the side plates 7 of the printing unit frame 6. An ink ribbon 15 is pulled out from the ribbon cassette 14 and fed to a printing position, i.e., a position on the platen 11 opposing the printing head 13. While the carriage is moved in transverse directions, the printing head 13 effects printing on a printing sheet via the ink ribbon 15 at the printing position on the platen 11.

Two feed roller pairs, one consisting of rollers 16 and 17 and the other consisting of rollers 18 and 19, are provided before and after the printing position A on the platen 11 in a sheet feed direction substantially tangential to the platen at the printing position. These feed rollers 16 to 19 are driven together with the platen 11 from a drive source, e.g., a motor (not shown), via a gear mechanism (not shown) to pinch and feed a printing sheet in the sheet feed direction shown by the arrow. They form together with the feed rollers 16 to 19 a sheet passage 21 passing through the printing position. The sheet passage 21 is substantially flat and is inclined so that its inlet end with respect to the printing position is found below the outlet end.

The tractor unit 5 includes a guide shaft 22, a transmission shaft 23, there shafts extending parallel in a transverse direction, and a pair of pin tractors 24 movable in the width direction of sheet. The top surface of the pin tractors 24 is inclined and lies substantially in the same plane as the sheet passage 21 on the inlet side thereof in the sheet feed direction. The pin tractors 24, as in an ordinary sheet feeder, consists of endless belts with pins passed round pulleys supported on the shafts 22 and 23. The pins of both the pin tractors 24 are adapted to be engaged in feed holes formed in a continuous printing sheet of paper P adjacent the opposite edges thereof. In this state, the pin tractors 24 are driven with the transmission shaft 23 coupled to the drive source of the feed rollers 16 to 19, whereby the continuous printing sheet P is introduced into the sheet passage 21 from behind the printer as shown by the arrow.

A manual sheet feed guide 25 which constitutes sheet guide means is supported between the side plates 7 of the printing unit frame 6 above the tractor unit 5. It has a top guide surface 26 which extends substantially horizontally and crosses the sheet passage 21 at a predetermined angle. Cut printing sheets are fed manually along the guide surface 26 of the guide 25 to the sheet passage 21 from behind the printer. A pair of edge guides 27 are mounted on the guide 25 for movement in directions perpendicular to the sheet feed direction so that the opposite edges of the printing sheets are guided by the edge guides 27.

Now a sheet feeder will be described, which can be removably set in a rear upper portion of the printer case 1 above and in the vicinity of the manual sheet feed guide 25.

Figure 2:
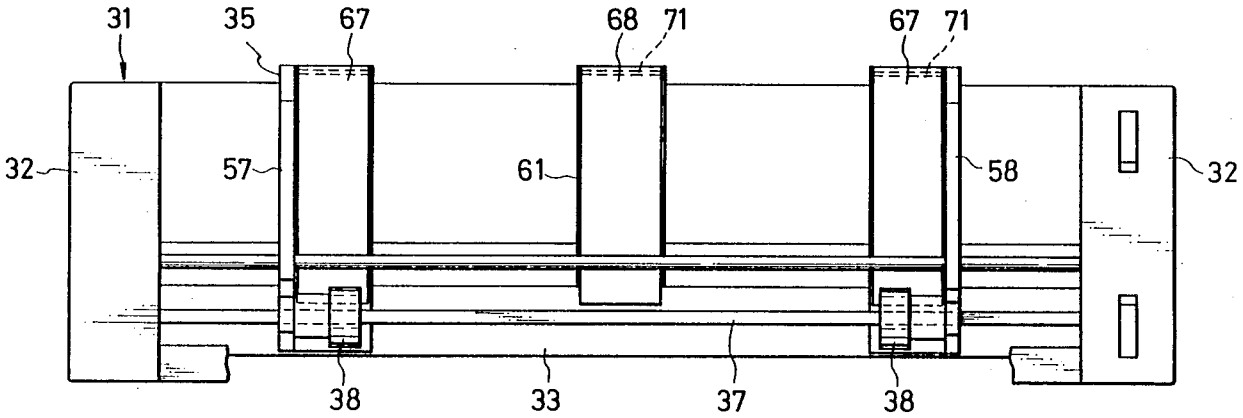
FIG. 2 is a contracted-scale plan view, partly broken away, showing a first stacker of the sheet feeder.
Figure 3:
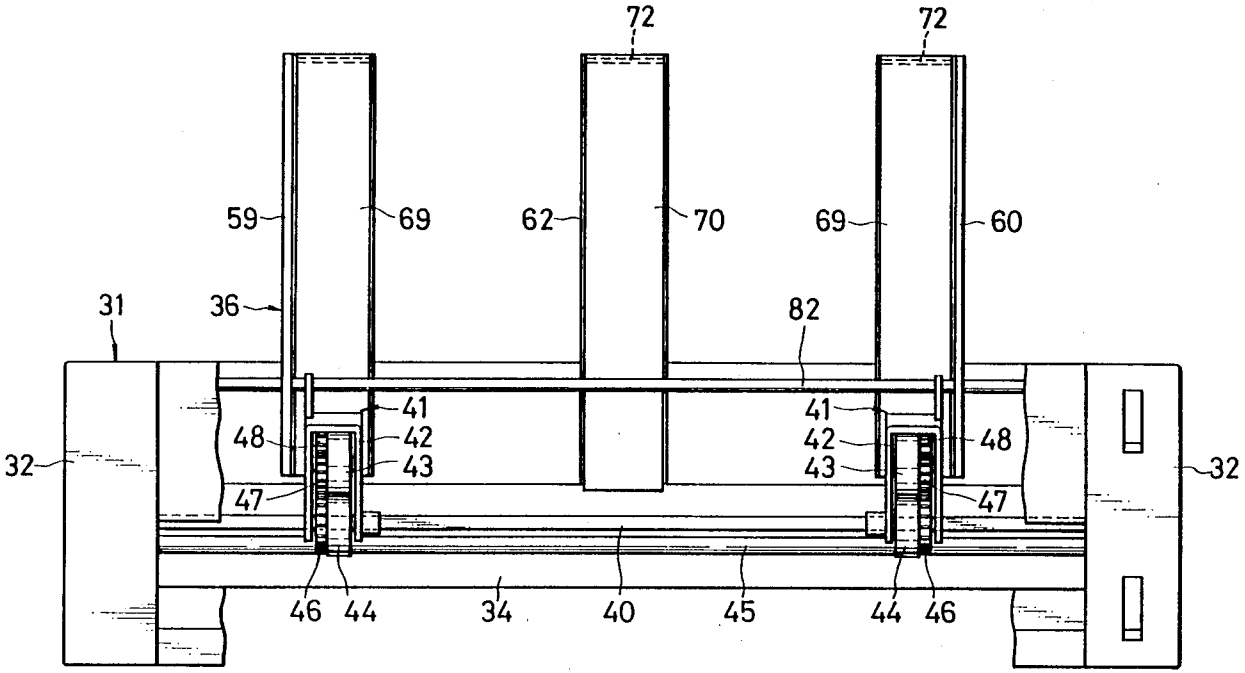
FIG. 3 is a contracted-scale plan view, partly broken away, showing a second stacker of the sheet feeder.

As shown in FIGS. 1 to 3, the sheet feeder comprises a flat box-like frame 31, which includes opposite side frames 32 and front and rear frames 33 and 34 extending in the width direction of the printing sheet and connected in the width direction of printing sheet and connecting the opposite side frames 32. Two stackers 35 and 36 which constitute respective first and second sheet holder sections, are supported in inclined states on the front and rear frames 33 and 34 of the sheet feeder frame 31. Stacks of cut sheets of different sizes are accommodated in the respective stackers 35 and 36.

The first stacker is disposed on the front side with respect to the second stacker 36. For this stacker 35 a front drive shaft 37 extending horizontally and in the width direction of the printing sheet is supported between the opposite side frames 32 of the sheet feeder frame 31. A pair, i.e., left and right, feed rollers, 38 are rotatably supported on the drive shaft 37 such that they are rotatably in unison with and slidable along the drive shaft 37. A stack of printing sheets S held in the first stacker 35 is urged against the feed rollers 38 by spring means (not shown). When the feed rollers 38 are rotated in the clockwise direction in FIG. 1, the printing sheets S in the stack are fed out one by one from the top sheet to be fed through an opening 39 provided at the bottom of the sheet feeder frame 31 to the sheet passage 21 of the printer as shown by the arrow.

The feed rollers 38 are driven by a drive mechanism which will be described later in detail.

For the second stacker 36 which is disposed on the rear side, a rear drive shaft 40 again extending horizontally and in the width direction of the printing sheet is supported between the opposite side frames 32 of the sheet feeder frame 31. A pair, i.e., left and right, feed units 41 are fittedly supported on the drive shaft 40. Each feed unit 41 consists of a support frame 42 and a pair of feed rollers 43 and 44 supported therein and spaced apart in the sheet feedout direction. A feed-out end of a stack of printing sheets S held in the second stacker 36 is urged by spring means (not shown) against the feed rollers 43 on the inlet side in the sheet feed direction. A driven roller 45 which extends horizontally between the opposite side frames 32 of the sheet feeder frame 31 is urged by spring means (not shown) against a lower portion of the outlet side feed rollers 44. When the drive shaft 40 is rotated, the feed rollers 43 and 44 are rotated via gears 46 to 48. With the rotation of the inlet side feed rollers 43 in the clockwise direction in FIG. 1, the printing sheets held in the second stacker 36 are fed out one by one from the top sheet in the direction of the arrow. Each fed-out printing sheet is fed by the co-operation of the outlet side feed rollers 44 and driven roller 45 through the opening 49 at the bottom of the sheet feeder frame 31 and along the guide surface 26 of the printer side manual sheet feed guide 25 to the sheet passage 21.

The feed rollers 43 and 44 are driven by a drive mechanism which will be described later in detail.

Now, the construction of the first and second stackers 35 and 36 will be described in detail. As shown in FIGS. 1 to 3, the front and rear frames 33 and 34 of the sheet feeder frame 31 have respective engagement grooves 51 and 52 extending transversely or in the width direction of the printing sheet S. They also have respective ridges 53 and 54, which are provided on the outlet side of the respective engagement grooves 51 and 52 in the sheet feed-out direction and extending transversely or in the width direction of the printing sheet. The ridges 53 and 54 face the respective engagement grooves 51 and 52. Urging rods 55 and 56 are supported for vertical movement between the opposite side frames 32, the rod 55 being found between the engagement groove 51 and ridge 53 and the other rod 56 being found between the engagement groove 52 and ridge 54, and they are urged against the respective feed rollers 38 and 43 by spring means (not shown).

The first stacker 35 includes a substantially L-shaped symmetrical pair, i.e., left and right, sheet support members 57 and 58 for supporting a stack of printing sheets S and an intermediate sheet support member 61 disposed between the members 57 and 58 for supporting the back of the printing sheet stack. The second stacker 36 also includes a substantially L-shaped symmetrical pair, i.e., left and right, sheet support members 61 and 62 which have a sufficient width and sufficient mechanical strength so that sheets held in the stackers 35 and 36 will not be deformed. The sheet support members 57 to 60 have engagement projections 63 and 64 projecting from the front end, and the sheet support members 61 and 62 have engagement projections 65 and 66 projecting from the lower surface. The forward engagement projections 63 and 64 engage with the ridges 53 and 54 serving as locking members, and rearward engagement projections 65 and 66 are engaged in the engagement grooves 51 and 52 serving as other locking members. The arrangement described above constitutes mounting means.

With the above arrangement of engagement, in the first stacker 35 the opposite side sheet support members 57 and 58 are supported on the front frame 33 for displacement in the width direction of the sheet, and the intermediate sheet support member 61 is detachably supported on the front frame 33 for displacement in the width direction of the sheet. Likewise, in the second stacker 36 the opposite side sheet support members 59 and 60 are supported on the rear frame 34 for displacement in the width direction of the sheet, and the intermediate sheet support member 62 is detachably supported on the rear frame 34 for displacement in the width direction of the sheet.

Further, in this embodiment, as is seen from FIG. 1 to 3, in the first stacker 35 the feed rollers 38 are fitted on the drive shaft 37 for displacement in the width direction of the sheet independently of the corresponding sheet support members 57 and 58 so that they can be brought to positions corresponding to the members 57 and 58 when the members 57 and 58 are displaced. Likewise, in the second stacker 36 the feed units 41 are fitted on the drive shaft 40 for displacement in the width direction of the sheet independently of the corresponding sheet support members 59 and 60 so that they can be brought to positions corresponding to the members 59 and 60 when the members 59 and 60 are displaced.

The first stacker 35 further includes urging members 67 and 68, and the second stacker 36 further includes urging members 69 and 70. These urging members 67 to 70 are pivoted at the rear end by pins 71 and 72 to the sheet support members 57 to 62 and have hooks 73 and 74 provided on the front end of the lower surface and capable of removably engaging the urging rods 55 and 56. Stacks of printing sheets in the stackers 35 and 36 are urged against the feed rollers 38 and 43 by the urging members 67 to 70.

Thus, in this embodiment of the sheet feeder, as shown in FIGS. 1 to 3, the sheet support members 57 to 60 may be displaced to adjust their positions such as to comply with the width of the printing sheets with the intermediate sheet support members 61 and 62 held assembled on the front and rear frames 33 and 34 between the opposite side sheet support members, whereby stacks of printing sheets can be held on the sheet support members 57 to 60 with the back of their central portions supported by the intermediate sheet support members 61 and 62.

When holding narrow printing sheets, e.g., postal cards, the intermediate sheet support members 61 and 62 are removed from the front and rear frames 33 and 34. To this end, the rear end of the intermediate sheet support members 61 and 62 is turned upwardly forwardly (i.e., to the left in FIG. 1). By so doing, the rearward engagement projections 65 and 66 of the intermediate sheet support members 61 and 62 are readily detached from the engagement grooves 51 and 52 of the front and rear frames 33 and 34 due to elastic deformation of the ridges 53 and 54 of the front and rear frames 33 and 34 or forward engagement projections 63 and 64 in engagement therewith. In this state, the intermediate sheet support members 61 and 62 are pulled up. As a result, the hooks 73 and 74 of the urging members 68 and 70 are detached from the urging rods 55 and 56, and also the forward engagement projections 63 and 64 are detached from the ridges 53 and 54. In this way, the intermediate sheet support members 61 and 62 can be removed together with the associated urging members 68 and 70 from the front and rear frames 33 and 34. Thus, the opposite side sheet support members 57 to 60 may be brought to positions close to one another and in compliance with the width of the narrow printing sheet, whereby stacks of very narrow printing sheets such as postal cards may be stably held on the sheet support members 57 to 60 of the stackers 35 and 36.

To install the intermediate sheet support members 61 and 62 on the front and ear frames 33 and 34 again, first the forward engagement projections 63 and 64 are engaged with the ridges 53 and 54, and in this state the rearward engagement projections 65 and 66 are engaged in the engagement grooves 51 and 52 while the hooks 73 and 74 of the urging members 68 and 70 are engaged with the urging rods 55 and 56. This is attained by causing elastic deformation of the engagement projections 63 and 64 and ridges 53 and 54 in engagement therewith. In this way, the intermediate sheet support members 61 and 62 may be readily assembled again on the front and rear frames 33 and 34.

Figure 4:
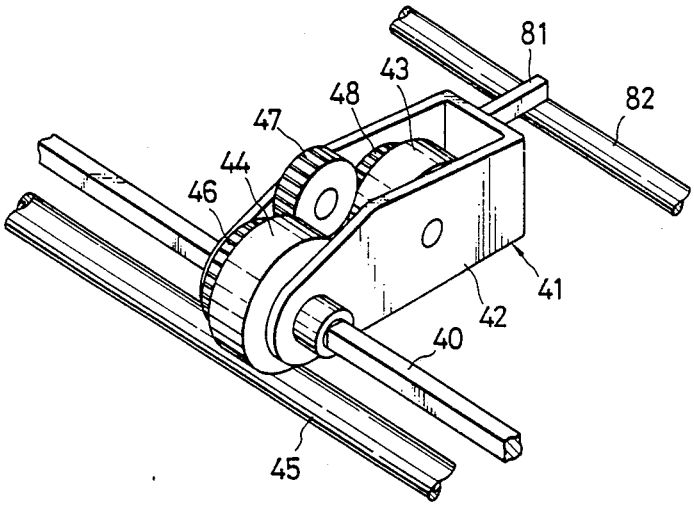
FIG. 4 is a fragmentary enlarged-scale perspective view showing a feeder unit provided on the second stacker.

Now, each feed unit 41 and related structure in the second stacker 36 will be described in detail. As shown in FIGS. 1 and 4, the support frame 42 of the feed unit 41 is substantially channel-shaped in plan view. Free end portions of its opposite side walls are supported on the drive shaft 40 for displacement in the width direction of the sheet with freed roller 44 and gear 46 disposed between them. The inlet side feed roller 43 is rotatably supported together with the gear 48 between the opposite side walls of the support frame 42, and the rotation of the drive shaft 40 is transmitted via the gears 46 to 48 to the inlet side feed roller 43. The outlet side feed roller 44 is supported on the drive shaft 40 via a clutch (not shown). The clutch is a oneway clutch such that it is rotated in unison with the drive shaft 40. A well-known clutch may be utilized as this one-way clutch.

The support frame 42 is turned by its own weight about the drive shaft 40 in the clockwise direction in FIG. 1, so that the inlet side feed roller 43 is in contact at all times with the printing sheet stack held on the second stacker 36. The support frame 42 has a stopper 81 projecting rearwardly from the rear end. When loading a printing sheet stack on the second stacker 36, the stopper 81 is brought into engagement with a rod 82 extending between the opposite side frames 32, thus preventing the support frame 42 from turning beyond a predetermined position and interfering with the loading of the printing sheet stack. The driven roller 45 is urged by spring means against a lower portion of the outer periphery of the outlet side feed roller 44.

With the above arrangement, rotation of the drive shaft 40 in the clockwise direction in FIG. 1 causes rotation of the outlet side feed roller 44 in the same direction and also causes rotation of the inlet side feed roller 43 in the same direction via the gears 46 to 48. With the rotation of the inlet side feed roller 43 the top sheet in the sheet stack on the second stacker 36 is fed out toward the outlet side feed roller 44. Since the outlet side feed roller 44 is also being rotated in the clockwise direction, the fed-out sheet is fed in a state pinched between the outlet side feed roller 44 and the driven roller 45, and it is positively fed through the opening 49 until its leading end reaches a position of contact between the pair of feed rollers 16 and 17 located at the inlet of the sheet passage 21 of the printer. As soon as the leading end of the sheet reaches the position of contact between the feed rollers 16 and 17, the drive shaft 40 is stopped, while at the same time the rotation of the feed rollers 16 and 17 is commenced, so that the sheet is continually fed toward the printing position A on the platen 11. At this time, even if a trailing end portion of the sheet is still in contact with the feed rollers 43 and 44, the sheet is positively fed out by the printer side feed rollers 16 and 17. At this time, the drive shaft is not rotated but only the outlet side feed roller 44 idles owing to the clutch action noted above. In other words, during this time the outlet side feed roller 43 is not rotated, so that the second sheet will never be erroneously fed out subsequent to the top sheet.

With the second stacker 36, it is possible to feed sheet pads, each of which consists of a stack of a plurality of sheets possibly including a carbon sheet and bound by glue at an end, in lieu of printing sheets one by one from the top one by the feed rollers 43. In such a sheet pad, the top sheet which is in direct contact with the feed rollers 43 tends to be fed out prior to the remaining sheets in the pad. Therefore, it is liable that the top sheet alone is fed out in a loop-like form to result in jamming in the sheet passage.

With the structure according to the invention, enlargement of such a loop can be suppressed with a positive pull-out action on the sheet feed-out side provided by auxiliary feed means constituted by the outlet side feed roller 44 and driven roller 44. Thus, each sheet pad can be fed along the sheet passage 21 of the printer to the printing position on the platen 11 smoothly and without the possibility of jamming that might otherwise be caused in the sheet passage.

Further, since he auxiliary feed means consisting of the rollers 44 and 45 is disposed on a long feed path between the inlet side feed roller 43 and printer side feed rollers 16 and 17, even a short sheet which can not be fed by the sole inlet side feed roller 43 until its leading end reaches the position of contact between the printer side feed rollers 16 and 17, can be fed out by the outlet side feed roller 44 until the leading end reaches the position of contact.

Figure 6:
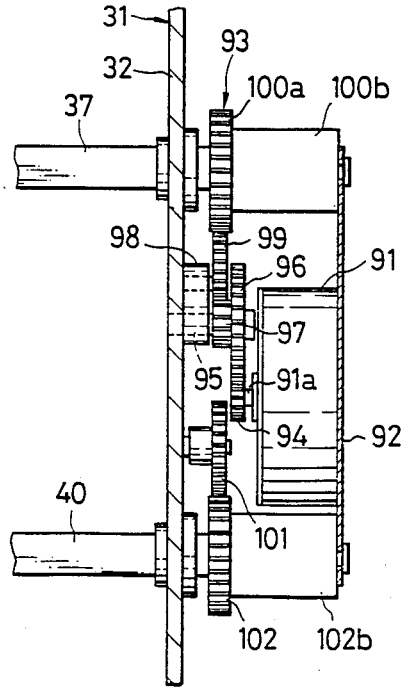
FIG. 6 is a fragmentary plan view showing the drive structure of FIG. 5.
Figure 5:
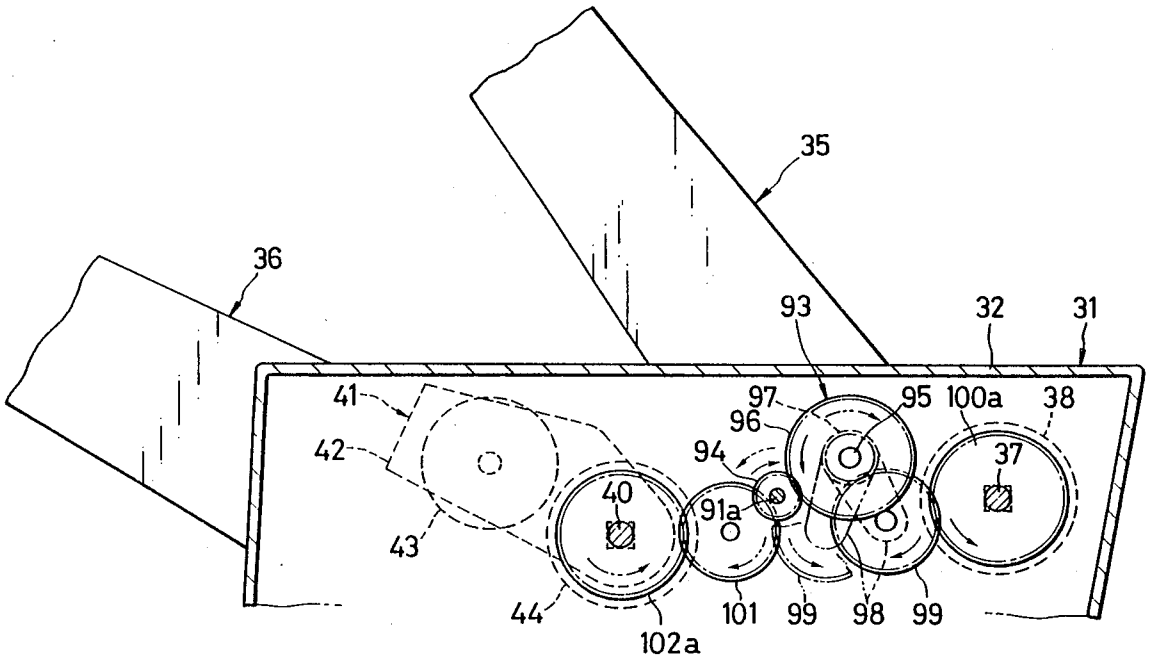
FIG. 5 is a fragmentary enlarged-scale sectional view, taken from the side opposite the side shown in FIG. 1, showing a drive structure of the sheet feeder.

Now, a structure for causing selective driving of the drive shafts 37 and 40 for the feed rollers 38 and 43, 44 of the first and second stackers 35 and 36 will be described in detail. As shown in FIGS. 5 and 6, a reversible drive motor 91 is mounted on one side frame 32 of the sheet feeder frame 31 via a mounting plate secured thereto. The motor 91 is operable in response to the operation of a stacker selection switch (not shown) provided on the printer. A selective coupling mechanism 93 is provided between the motor 91 on one hand and the drive shafts 37 and 40 on the other hand. Either one of the drive shafts 37 and 40 is selectively coupled to the motor 91 depending on the direction of rotation of the motor 91, causing rotation of the feed rollers 38 in the first stacker 35 or the feed rollers 43 and 44 in the second stacker in the direction of the feeding sheet.

In the selective coupling mechanism 93, a first gear 94 is secured to a shaft 91*a* of the motor 91. The rotation of the first gear 94 is transmitted via a second gear 96, which is mounted on the side frame 32 via a shaft 95 such as to be in mesh with the first gear 94, to a third gear 97 integral with the second gear 96. A lever 98 which serves as rotational direction sensor has a stem rotatably mounted on a shaft 95 and carries at its free end a fourth gear 99 in mesh with the third gear 97. The lever 98 can be turned about the shaft 95 in the direction of rotation of the second and third gears 96 and 97. This means that the rotation of the lever 98 is caused by the frictional force of mesh between the third and fourth gears 97 and 99. The rotation of the lever 98 causes a swing of the fourth gear 99.

A fifth gear 100*a* which is coupled to one end of the drive shaft 37, is adapted to be brought into mesh with the fourth gear 99 that has swung to the right in FIG. 5 with the turning of the lever 98 in the counterclockwise direction in the Figure. This gear 100*a* and drive shaft 37 are coupled together via a one-way clutch 100*b*. A sixth gear 101 is supported on the side frame 32 such that it is brought into mesh with the fourth gear 99 having been swung to the left in the Figure with a turning of the lever 98 in the clockwise direction in the Figure. The sixth gear 101 is in mesh with a seventh gear 102*a* which is coupled via a one-way clutch 102*b* to one end of the drive shaft 40 in the second stacker 36. The drive shafts 37 and 40 are adapted to be rotated in the same direction when and only when the fifth and the seven gears 100*a* and 102*a* are rotated in the counterclockwise direction in FIG. 5 via the one-way clutches 100*b* and 102*b*. The one-way clutches 100*b* and 102*b* may be well-known clutches, e.g., roller clutches.

When the second and third gears 96 and 97 are rotated in the counterclockwise direction as shown by the solid arrow in FIG. 5 with clockwise rotation of the shaft 91*a* of the motor 91 caused in response to an operation of the stacker selection switch to select the first stacker, the lever 98 is turned in the counterclockwise direction. As a result, the fourth gear 99 is brought to a position shown by the solid line and meshed with the fifth gear 100*a*. The rotation of the third gear 97 thus is transmitted to the fifth gear 100*a* to cause rotation thereof in the counterclockwise direction as shown by solid arrow, this causing rotation of the drive shaft 37 of the first stacker 35 in the same direction via the one-way clutch 100*b*. With this rotation, the feed roller 38 is rotated in the feeding direction to feed out a printing sheet from the first stacker 35.

When the second and third gears 96 and 97 are rotated in the clockwise direction with counterclockwise direction of the shaft 91*a* of the motor 91 as shown by broken arraw in FIG. 5 in response to an operation of the stacker selection switch to select the second stacker, the lever 98 is turned in the clockwise direction. As a result, the fourth gear 99 is swung to the position shown by the broken line in the Figure and meshes with the sixth gear 101. The rotation of the third gear 97 thus is transmitted via the sixth gear 101 to the seventh gear 102*a* to cause rotation thereof in the counterclockwise direction as shown by the broken arrow. The one-way clutch 102*b* thus permits rotation of the feed rollers 43 and 44 in the feeding direction via the drive shaft 40 in the second stacker 36 to feed a printing sheet therefrom.

It is to be understood that with this embodiment of the sheet feeder, by switching the direction of rotation of a single drive motor 91 selective rotation of either the feed rollers 38 of the first stacker 35 or the feed rollers 43 and 44 of the second stacker 36 is caused. It is thus possible to selectively feed printing sheets of different sizes held in the stackers 35 and 36 to the sheet passage 21 of the printer.

Figure 7:
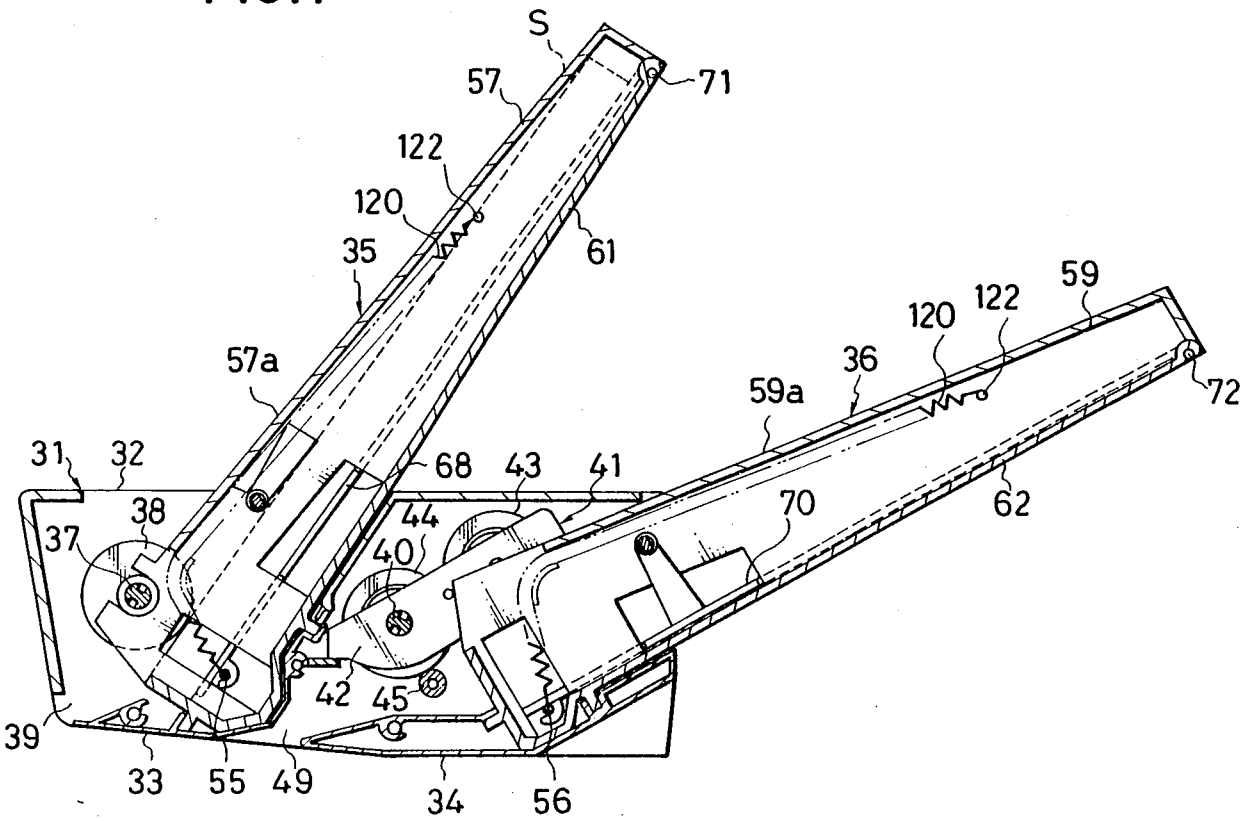
FIG. 7 is a longitudinal sectional view showing a different example of the structure of the first and second stackers.

A different example of the structure of the first and second stackers will now be described with reference to FIG. 7. In the Figure, parts like those in the preceding embodiment are designated by like reference numerals, and their detailed description is omitted. In this case, urging members 68 and 70 provided in the first and second stackers 35 and 36 are pivoted at the rear end by pins 71 and 72 to the opposite side sheet support members 57 and 59, and their lower or front ends are connected together by urging rods 55 and 56 extending in the width direction of the sheet, so that the opposite side sheet support members are turned in union with each other. Springs as urging means are stretched between pins 122 in side frames 57*a* of the opposite sheet support members 57 and 59 and urging rods 55 and 56 to urge the urging members 68 and 70 toward the corresponding feed rollers 38 and 43. The printing sheet stacks in the first and second stackers 35 and 36 are urged against the feed rollers 38 and 43 by the urging members 68 and 70.

Thus, in this sheet feeder, by adjusting the positions of the opposite side sheet support members 57 and 59 to comply with the width of the printing sheet and assembling the intermediate sheet support members 61 and 62 on the frames 33 and 34, it is possible to hold printing sheets on the opposite side sheet support members 57 and 59 and support the back of the sheet stacks by the intermediate sheet support members 61 and 62 via the urging members 68 and 70.

The construction of the embodiment described above is by no means limitative, and various changes and modifications can be made in the details of various parts without departing from the scope and spirit of the invention.

What is claimed is:

1. A sheet feeder for a printer, said sheet feeder being mounted in said printer for feeding out cut printing sheets one by one to a printing position in said printer and comprising:

first and second sheet accommodation sections for accommodating respective stacks of printing sheets;

first and second feed roller means provided for said respective first and second sheet accommodation sections for feeding out printing sheets from said sheet accommodation sections to said printing position;

a reversible drive motor; and a selective coupling mechanism for sensing the direction of rotation of said reversible drive motor, selectively coupling said drive motor to either said first or second feed roller means in accordance with the sensed direction of rotation and causing rotation of the selected feed roller means in a feeding direction, wherein:

said selective coupling mechanism includes first and second rotational drive members rotated in unison with said first and second feed roller means, a third rotational drive member rotated in unison with said drive motor, a fourth rotational drive member in engagement with said third rotational drive member at all times and capable of being selectively engaged with said first and second rotational drive members, and a rotation direction sensing member, having two ends, carrying and causing engagement of said fourth rotational drive member with either one of said first and second rotational drive members by sensing the direction of rotation of said third rotational drive member with the rotation of said drive motor; and said rotation direction sensing member being rotatably mounted at one end for rotation about the axis of said third rotational drive member, and said fourth rotational drive member being rotatably carried at the other end of said rotation direction sensing member.

2. The sheet feeder according to claim 1, wherein said first to fourth rotational drive members are gears.

3. A sheet feeder for a printer, said sheet feeder being mounted in said printer for feeding out cut printing sheets one by one to a printing position in said printer and comprising:

first and second sheet accommodation sections for accommodating respective stacks of printing sheets;

first and second feed roller means provided for said respective first and second sheet accommodation sections for feeding out printing sheets from said sheet accommodation sections to said printing position;

a reversible drive motor;

a selective coupling mechanism for sensing the direction of rotation of said reversible drive motor, selectively coupling said drive motor to either said first or second feed roller means in accordance with the sensed direction of rotation and causing rotation of the selected feed roller means in a feeding direction;

a sheet feeder frame, in which at least one of said first and second sheet accommodation sections includes a pair of opposite side sheet support members supported in said sheet feeder frame and capable of being located at the opposite sides of a printing sheet stack and an intermediate sheet support member disposed intermediate between said pair of opposite side sheet support members;

an urging member provided on said intermediate sheet support member for urging the stack of printing sheets in an urging direction against said feed roller means;

guide means for guiding a displacement of at least one of said opposite side sheet support members on said sheet feeder frame in the width direction of a printing sheet; and mounting means for detachably mounting said intermediate sheet support member together with said urging member on said sheet feeder frame.

4. The sheet feeder according to claim 3, wherein said mounting means includes a frame member extending in said sheet feeder frame in the width direction of the printing sheet, an engagement member pair consisting of front and rear engagement members provided on said frame member and extending in the width direction of the printing sheet and a pair of projections provided on said intermediate sheet support member and capable of being elastically engaged with said engagement members to thereby support said intermediate sheet support member on said sheet feeder frame at a predetermined inclination angle.

5. The sheet feeder according to claim 4, wherein one of said pair of engagement members is an elongate ridge formed on said frame member and extending in the width direction of the printing sheet, and the other one of said engagement members is an elongate groove formed in said frame member.

6. The sheet feeder according to claim 3, wherein said first and second feed roller means are capable of being displaced in the width direction of printing sheet and independently of the associated sheet support members.

7. The sheet feeder according to claim 3, wherein on said pair of opposite side sheet support members are provided respectively other urging members for urging the stack of printing sheets against said feed roller means.

8. A sheet feeder for a printer, said sheet feeder being mounted in said printer for feeding out cut printing sheets one by one to a printing position in said printer and comprising:

first and second sheet accommodation sections for accommodating respective stacks of printing sheets;

first and second feed roller means provided for said respective first and second sheet accommodation sections for feeding out printing sheets from said sheet accommodation sections to said printing position;

a reversible drive motor;

a selective coupling mechanism for sensing the direction of rotation of said reversible drive motor, selectively coupling said drive motor to either said first or second feed roller means in accordance with the sensed direction of rotation and causing rotation of the selected feed roller means in a feeding direction;

a sheet feeder frame, in which at least one of said first and second sheet accommodation sections includes a pair of opposite side sheet support members supported in said sheet feeder frame and capable of being located at the opposite sides of a printing sheet stack and an intermediate sheet support member disposed intermediate between said pair of opposite side sheet support members for supporting the back of said printing sheet stack;

guide means for guiding a displacement of at least one of said opposite side sheet support members of said sheet feeder frame in the width direction of a printing sheet; and mounting means for detachably mounting said intermediate sheet support member in said sheet feeder frame, wherein on said pair of opposite side sheet support members and said intermediate sheet support member are mounted respectively urging members for urging the stack of printing sheets against said feed roller means, said urging members being capable of being moved in the urging direction by a connecting rod provided in said sheet feeder frame and extending in the width direction of a sheet.

* * * * *